United States Patent [19]

Gwyther

[11] 4,395,858

[45] Aug. 2, 1983

[54] PANEL MOUNTING SYSTEM AND METHOD

[76] Inventor: Donald W. Gwyther, 2812 N.W. Thurman St., P.O. Box 10559, Portland, Oreg. 97210

[21] Appl. No.: 280,332

[22] Filed: Jul. 6, 1981

[51] Int. Cl.[3] ..... E04B 1/74; E04B 1/40

[52] U.S. Cl. ..... 52/489; 52/509; 52/714

[58] Field of Search ..... 52/489, 480, 714, 718, 52/509

[56] References Cited

U.S. PATENT DOCUMENTS

| | | | |
|---|---|---|---|
| 3,300,926 | 1/1967 | Heirich | 52/489 X |
| 3,300,934 | 1/1967 | Waizenhofer | 52/489 X |
| 3,518,800 | 7/1970 | Tank | 52/489 X |
| 3,916,577 | 11/1975 | Vare | 52/489 |
| 4,223,505 | 9/1980 | Krebel et al. | 52/509 |
| 4,266,384 | 5/1981 | Orals et al. | 52/714 X |
| 4,272,937 | 6/1981 | Brugman | 52/489 X |
| 4,309,858 | 1/1982 | Anderle | 52/489 X |
| 4,361,996 | 12/1982 | Smith | 52/484 |

FOREIGN PATENT DOCUMENTS

| | | | |
|---|---|---|---|
| 1136477 | 9/1962 | Fed. Rep. of Germany | 52/489 |
| 1260133 | 1/1972 | United Kingdom | 52/489 |

*Primary Examiner*—J. Karl Bell

*Attorney, Agent, or Firm*—Klarquist, Sparkman, Campbell, Leigh, Whinston & Dellett

[57] ABSTRACT

A system for alignably mounting a plurality of panels, each of which has a pair of substantially parallel, facing engagement surfaces on its back side. The system typically includes the following components: (1) a plurality of substantially parallel channel members, each of which normally includes rearwardly extending flanges adjacent its lateral edges; (2) a plurality of clipping devices adapted to be mounted to each of the channel members, each of the clipping devices including opposing, rearwardly extending engagement fingers for engaging the channel member flanges, a pair of facing, forwardly and transversely extending gripping flanges for engaging the engagement surfaces of the panel, the gripping flanges being flexed toward each other to grip the engagement surfaces, and lever members for releasing the gripping force on the engagement surfaces, the lever members extending beyond a lateral edge of the panel being engaged by the device to permit operation thereof from a frontal position when a panel is engaged by the gripping flanges.

14 Claims, 9 Drawing Figures

FIG. 1
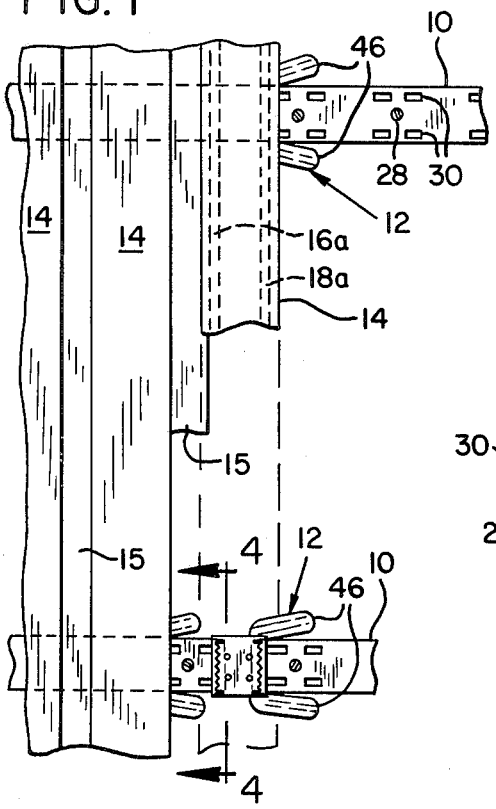
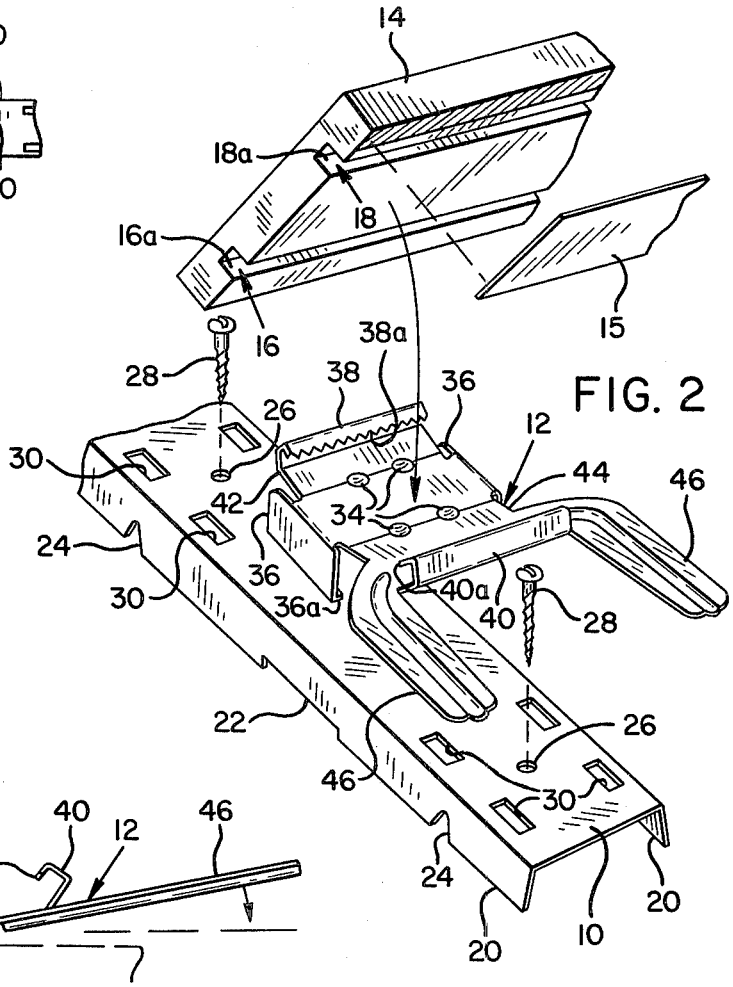
FIG. 2
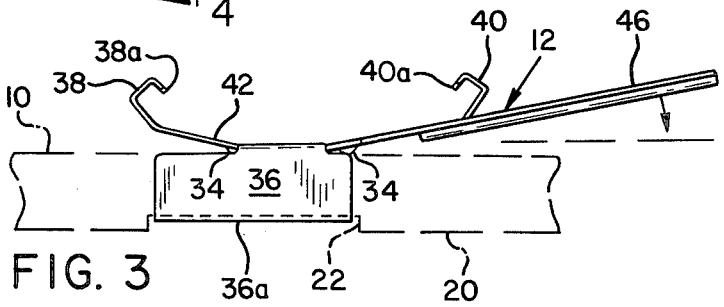
FIG. 3
FIG. 4
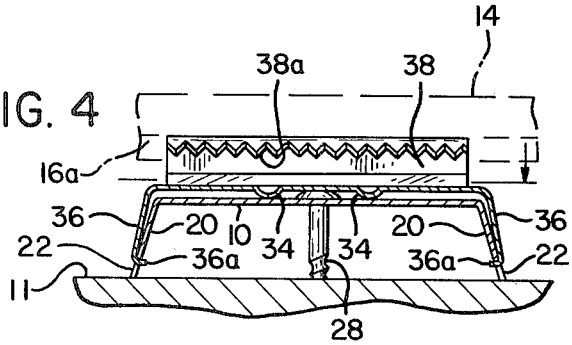
FIG. 6
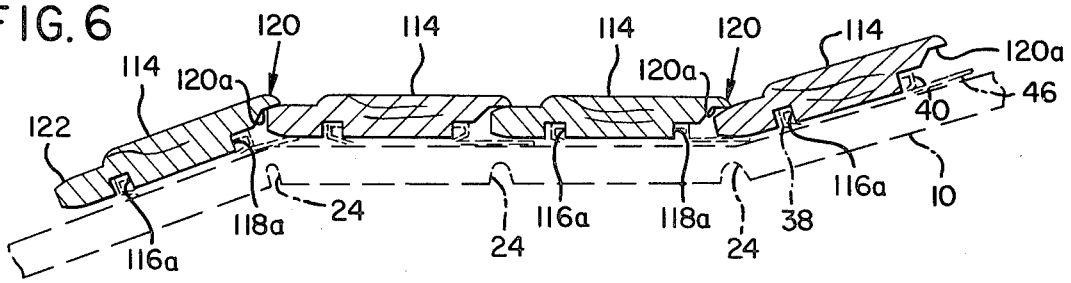

FIG. 5
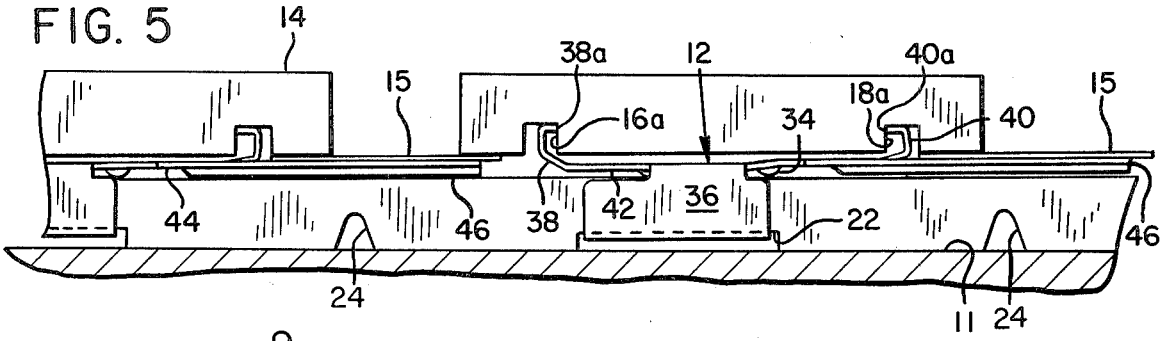
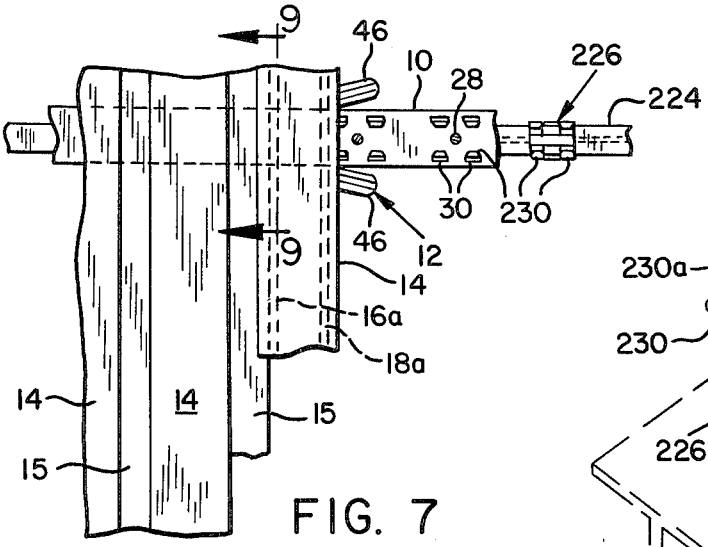
FIG. 7
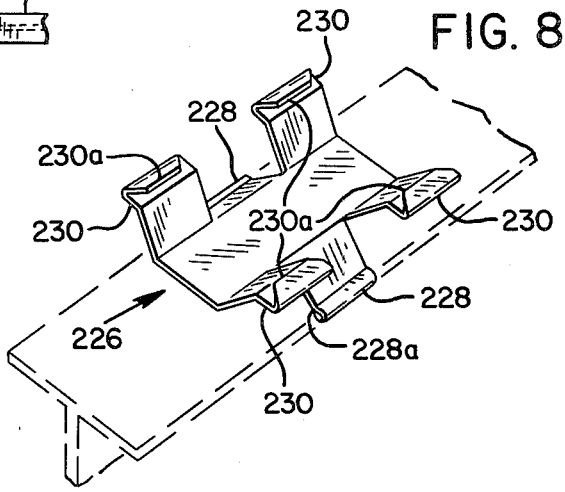
FIG. 8
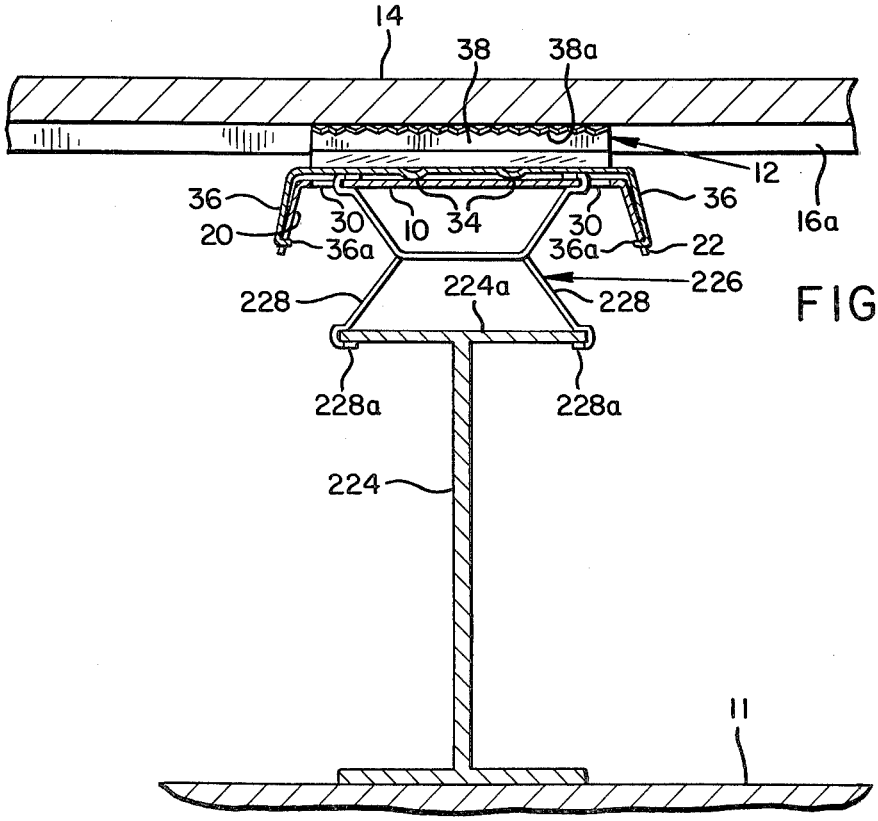
FIG. 9

PANEL MOUNTING SYSTEM AND METHOD

BACKGROUND OF THE INVENTION

1. Field of the Invention

The invention relates generally to a system for mounting panels to a surface and more particularly to a system for removably mounting acoustic panels.

2. Description of the Prior Art

Various systems have been proposed for mounting panels or boards to stationary walls. Most of these systems utilize fasteners, such as nails or screws, which are embedded in the panels to mount the panels to the surface being covered. These fastening systems are normally adequate when the panels are to be permanently mounted to the surface. However, in order to remove the panels from the surface the panels are typically destroyed or at least severely marked. This has not been of great concern to those in the art, since when the panels are removed, they are often discarded.

Since acoustics are not normally of primary concern with panel mounting systems, it typically does not matter that when a panel which is mounted through the use of embedded fasteners is subjected to sustained, loud noise, such as music, the panel is permitted to vibrate to a greater extent at the portions which are remote from the embedded fastener than the portions adjacent the embedded fastener. However, such non-uniformity in vibration can have adverse acoustic effects which may be important in concert halls and the like where acoustics are of vital concern. Moreover, despite careful preconstruction engineering work, the acoustics in a newly constructed concert hall may be imperfect. Destructive removal of acoustic panels can, of course, involve a substantial expense.

In mounting hardwood boards, it is common to predrill holes before driving in a nail or screw in order to minimize the possibility of splitting. This is a time-consuming and therefore expensive operation but is often considered to be necessary in order to maintain the integrity of the boards.

Various means have been developed for concealing the fastener which has been embedded in the wall panel. Often a putty-like material is used to cover the nail or screw head which has been driven into the panel. This putty is then often concealed through the use of stains. However, when a natural, unstained finish is desired, the fastener-concealing putty may be ineffective. In any event, any means to conceal the nail or screw adds at least one additional step to the mounting procedure and therefore increases cost.

The paneling of rounded corners in buildings has been a long-standing problem for building designers and contractors. Various means have been provided, which typically include some sort of fastening means embedded in the panels covering the corners. As noted above, such embedded fasteners can detract from the acoustic properties of the panels. Unfortunately, rounded corners are very prevalent in concert halls and the like where acoustics are of vital importance. The problems involved in paneling rounded corners has often resulted in elimination of these corners from concert halls, thereby often comprising the quality of the acoustics of the hall.

Hence, it is a primary object of the present invention to provide an improved panel mounting system which effectively and reliably overcomes the aforementioned limitations and drawbacks of the prior art proposals.

More specifically, the present invention has as its objects one or more of the following, taken individually or in combination:

(1) to provide a system in which panels, normally narrow boards, can be mounted to a wall in such a way that removal and rearrangement of the panels is possible without necessitating destruction or damage to the panels, thus facilitating redecorating and permitting modification of the acoustic properties of a room;

(2) to develop means for mounting acoustic panels to a wall which will permit more uniform vibration than is possible when embedded fasteners are used;

(3) the provision of a panel mounting clip which may be used to mount hardwood boards to a wall in such a way that splitting forces need not be imposed on the boards;

(4) the development of a panel mounting system in which the fastener is concealed, thereby eliminating the problem of covering or otherwise concealing an exposed fastener;

(5) the provision of a panel mounting system which is inexpensive to fabricate and which requires a low level of skill in order to use;

(6) to provide a method for mounting a wide variety of panel designs which will facilitate uniform spacing of the panels and which permits either spaced, abutting, overlapping, or interlocking disposition of adjacent panels;

(7) the provision of a panel mounting system which is adapted to mount panels to either planar or rounded surfaces, whether concave or convex; and (8) the provision of a panel mounting clip which may be used in conjunction with existing support systems.

SUMMARY OF THE INVENTION

This invention responds to the problems presented in the prior art by providing a system for alignably mounting a plurality of panels, each of which has a pair of substantially parallel, facing engagement surfaces on its back side. The system typically includes the following components: (1) a plurality of substantially parallel channel members, each of which normally includes rearwardly extending flanges adjacent its lateral edges; (2) a plurality of clipping devices adapted to be mounted to each of the channel members, each of the clipping devices including opposing, rearwardly extending engagement means for engaging the channel member flanges, a pair of facing, forwardly and transversely extending gripping flanges for engaging the engagement surfaces of the panel, flexion means for flexing the gripping flanges toward each other to grip the engagement surfaces, and lever means for releasing the gripping force on the engagement surfaces, the lever means extending beyond a lateral edge of the panel being engaged by the device to permit operation thereof from a frontal position when a panel is engaged by the gripping flanges. The invention thus provides means for detachably mounting panels to a surface in such a way that the fastening means are concealed and are not embedded in the panels, thereby eliminating splitting forces inherent in the use of embedded fasteners and promoting more uniform vibration in the event this system is to be utilized where acoustics are of concern.

The flanges of the channel members may include opposing channel deformation notches which are adapted to reduce the resistance of the channel member to bending along transverse lines defined between the opposing channel deformation notches. These channel deformation notches would be disposed along the channel members between adjacent clipping devices to permit bending of the channel members between the panels engaged by the clipping devices. This feature is particularly well suited for concert halls and the like, which very often include a large number of curved wall surfaces.

One type of panel which may be used with the system includes a first lateral edge having a beveled, generally forwardly facing surface, and a second lateral edge having an overlying extension with a planar, rearwardly facing surface adapted to overlie the beveled first lateral edge of the adjacent panel. The cooperation of the beveled and overlying surfaces provides means for paneling both concave and convex surfaces as well as a wide variety of obtuse angles. With this arrangement, the overlying extension is normally in contact with the beveled surface of the adjacent panel, thereby providing a cosmetically attractive and acoustically efficient wall covering.

The invention may alternatively be defined as a method for removably and alignably mounting a plurality of narrow panels to a stationary wall, wherein each of the panels has a pair of opposing engagement surfaces. Thus defined, the method includes the following steps: (1) mounting a plurality of parallel channel members to the wall, the channel members having opposed, rearwardly extending flanges, the flanges defining spaced clip engagement notches which oppose like notches in the opposing flange; (2) alignably clipping a clipping device to each of the channel members, the clipping devices each having a pair of rearwardly extending fingers for engaging the clip engagement notches, a pair of forwardly extending gripping flanges, and a pair of lever members, one of which extends outwardly from each lateral edge of the device and along a lateral edge of the channel member to which the device is mounted, the lever members being at least about half as long as the width of the panels being mounted; (3) aligning the engagement surfaces of the panel with the gripping flanges of the devices; and (4) pressing the panel rearwardly so that the gripping flanges of each of the devices engage the engagement surfaces of the panel, while leaving a portion of each of the lever members exposed so that rearward pressing of the lever members of any one clipping device releases the panel from that one device.

The channel member flanges may also define opposing channel deformation notches disposed in alternating arrangement with the clip engagement notches. When channel deformation notches are provided, the method may include the additional step of first bending the channel members at the channel deformation notches to conform the channel members to any variations in the surface. The term "variations" as used herein includes curves and obtuse corners.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a fragmentary, partially cutaway plan view of one embodiment of the present invention, showing the mounting of panels with attached pliable strips;

FIG. 2 is a blown-up view of the embodiment of FIG. 1 showing a channel member, a clipping member, a panel, and a pliable strip;

FIG. 3 is a side elevation view of a clipping device of the present invention depicting in phantom a channel member to which it is adapted to be mounted;

FIG. 4 is a sectional view taken along line 4—4 of FIG. 1 showing the panel resting upon the clipping device but not yet pressed to its final position;

FIG. 5 is a side elevation view of the embodiment of FIG. 1 showing the panels and strips in their finally mounted position;

FIG. 6 is an embodiment of the present invention which utilizes panels adapted to compensate for wall surface variations;

FIG. 7 is a fragmentary plan view of an embodiment of the present invention which is adapted to be mounted to a premounted rail system;

FIG. 8 is a perspective view of a channel mounting clip which is adapted to be used with the embodiment of FIG. 7; and FIG. 9 is an end elevation sectional view taken along line 9—9 of FIG. 7.

DETAILED DESCRIPTION OF THE PREFERRED EMBODIMENTS

Structure of Embodiment of FIGS. 1-5

The principles of this invention are particularly useful when embodied in a panel mounting system of the type illustrated in FIGS. 1-5. Briefly, the system includes channel members 10 which are adapted to be mounted to a wall 11. The term "wall" as used herein is intended to include any surface which will receive the described channel members 10. This may be a flat, rounded, or cornered surface, or may merely comprise a plurality of aligned studs. Clipping devices 12, which are clipped to channel members 10, engage panels 14 adjacent a pair of longitudinally extending, parallel grooves 16 and 18 in the panels. The normal "panel" used with the present invention would be a relatively narrow wooden board, but this term is intended to encompass any other linear, relatively narrow construction material.

Channel members 10 are relatively rigid in construction and are typically fabricated of galvanized steel plate, normally 24 gauge. Channel members 10 include rearwardly extending flanges 20, if it is assumed that the rear of the system is in the direction of wall 11, below the channel member depicted in FIG. 2. Clip engaging notches 22 are evenly spaced along the length of each of channel member flanges 20, disposed so that the clip engaging notches of each of the flanges are in alignment with corresponding notches in the opposing flange. Narrower but deeper channel deformation notches 24 are also spaced along each of the flanges 20, in alternating relation with clip engaging notches 22, and aligned with corresponding notches in the opposing flange so that transversely extending, weakened regions are defined in the channel members.

Each channel member 10 includes longitudinally spaced holes 26 which are adapted to receive screws 28 for mounting channel members 10 to wall 11. Holes 26 are disposed between channel deformation notches 24 for reasons which will become evident as this description continues. Slots 30 are also provided, the purpose of which will be explained below.

Clipping device 12 is typically fabricated of 0.015 inch half-hard stainless steel, hardened to Rockwell C-301, to provide the strength and resiliency desirable in this component. In the depicted embodiment clipping device 12 includes four centrally disposed dimples 34. As shown in FIG. 4, dimples 34 contact the upper surface of the channel member. This contact is necessary in order to prevent the possibility of vibration between channel member 10 and clipping device 12 which might otherwise occur when the system is subjected to loud music, such as would be present in a concert hall or the like.

A pair of engagement fingers 36 extend rearwardly which, again, is in the direction of wall 11 from clipping device 12. These fingers 36 are designed to engage clip engaging notches 22 on each of the flanges 20 of channel member 10. A flange engagement lip 36*a* is provided along the rearward edge of each of the engagement fingers 36 in order to effect a sure engagement between clipping device 12 and channel member 10.

Clipping device 12 also includes a pair of facing, generally forwardly extending gripping flanges 38 and 40. Gripping flanges 38 and 40 terminate in generally inwardly extending engagement teeth 38*a* and 40*a*. The term "inwardly" refers to the fact that the engagement teeth extend inwardly toward the center of clipping device 12, rather than outwardly therefrom. As shown best in FIG. 3, the inwardly extending engagement teeth 38*a* and 40*a* also extend somewhat rearwardly prior to the mounting of a panel 14 thereto. Once a panel 14 has been engaged by clipping device 12, as shown in FIG. 5, engagement teeth 38*a* and 40*a* extend directly toward one another.

As shown in FIG. 3, clipping device 12 also includes outwardly extending portions 42 and 44; as depicted in FIG. 5, once a panel 14 is engaged by clipping device 12, outwardly extending portions 42 and 44 tend to take a planar configuration.

A pair of lever arms 46 extend from body 32 adjacent outwardly extending portion 44. In the depicted embodiment lever arms 46 first extend outwardly, and once they have extended beyond the periphery of channel member 10, turn to extend in the general direction of the linear axis of channel member 10. Thus, lever arms 46 may be pressed rearwardly and will clear channel member 10 and its flanges 20.

As shown best in FIGS. 1 and 5, lever arms 46 extend for a distance which is at least about half the width of the panel 14 being mounted. In any event, it is necessary that lever arms 46 extend beyond the lateral edge of the mounted panel 14 to permit operation of the lever arms when a panel is mounted to clipping device 12.

As noted above, panel 14 includes a pair of longitudinally extending, parallel grooves 16 and 18. Grooves 16 and 18 each include an engagement surface 16*a* and 18*a*, which, as shown in FIG. 5, oppose each other and are adapted to be engaged by engagement teeth 38*a* and 40*a* of gripping flanges 38 and 40.

Operation of Embodiment of FIGS. 1–5

As shown in FIG. 1, channel members 10 are mounted in alignment in a direction which is perpendicular to the intended direction of panels 14. Channel members 10 are mounted in place through the use of screws 28 which extend through holes 26. The wall 11 to which they are mounted may be a continuous surface, as depicted, or may comprise a plurality of aligned studs (not shown). When channel members 10 are mounted to studs, flanges 20 are typically disposed to each side of the stud, while the central portion of the channel member is screwed into position flush with the stud.

Clipping devices 12 are clipped to channel members 10 by merely pressing them rearwardly toward the channel member in alignment with clip engaging notches 22 until flange engagement lips 36*a* on engagement fingers 36 engage flanges 20 at the clip engaging notches. Flange engagement lips 36*a* prevent unintended removal of clipping device 12, while clip engaging notches 22 prevent sliding of clipping device 12 along channel member 10. As shown in FIG. 1, clipping devices 12 should be mounted to channel members 10 for the entire length of extension of the panel 14.

Once the required clipping devices 12 are mounted to channel member 10, panel 14 may be mounted into position. As noted above, the depicted panel 14 includes a pliable strip 15 mounted to it along one lateral edge. Strip 15 is typically mounted by adhesives and, in any event, must be affixed to panel 14 before the panel is mounted to clipping devices 12.

In order to mount panel 14, it is first centered in position with grooves 16 and 18 disposed directly over gripping flanges 38 and 40. This position is depicted in FIG. 4. Once it is centered, panel 14 is pressed rearwardly until engagement teeth 38*a* and 40*a* of gripping flanges 38 and 40 are spread outwardly to receive engagement surfaces 16*a* and 18*a* of grooves 16 and 18. It may be desirable to press rearwardly on lever arms 46, thus opening clipping device 12 at the same time that panel 14 is pressed into place, but the configuration of gripping flanges 38 and 40 is such that this is normally not necessary. The finally mounted position of panel 14 is depicted in FIG. 5. Once a particular panel 14 is pressed into position along its entire length, the next, laterally adjacent panel and its clipping devices are mounted in a similar fashion.

A variation of the above-described assembly procedure is to first engage clipping devices 12 in panel 14 at a spacing which corresponds to the spacing of channel members 10 and then press the panel and clipping devices into place on the channel members. This is not the preferred mode, however, because it may be difficult to precisely calculate this spacing.

Strips 15 adjacent panels 14 serve to conceal lever arms 46 and thereby provide a cosmetically attractive paneling system. As shown in FIG. 5, panels 14 are maintained in an elevated position above clipping device 12; so the system also provides an acoustically proper design which permits uniform vibration of panels 14 while preventing any vibration of the mounting system.

In order to remove any of the panels 14, it is merely necessary to press rearwardly on lever arms 46 of each clipping device 12 by locating the lever arms under strip 15 and then pressing rearwardly on strip 15. Lever arms 46 may be pressed rearwardly beyond channel member 10, thus causing gripping flange 40 and its engagement teeth 40*a* to disengage panel 14 at its engagement surface 18*a* to permit removal.

The present invention may also be used with panels (not shown) having lateral edges which are adapted to abut one another. With such panels, the assembly procedure is the same. Once assembled, the adjacent panel itself, rather than strip 15, will conceal the lever arms. Therefore, to remove the panels, one must start with the last panel which has been mounted, pressing rearwardly on lever arms 46 of the clipping devices 12 holding that last panel in place, removing that panel to reveal the lever arms of the clipping devices securing the next panel in place.

Structure of Embodiment of FIG. 6

The embodiment of FIG. 6 is identical to that of FIGS. 1–5 except for the panels, which in this embodiment are identified with the numeral 114. Like panels 14, panels 114 include a pair of longitudinally extending, parallel, opposed engagement surfaces 116*a* and 118*a*. Panels 114 are neither spaced from nor in abutment with each other but rather are in a slightly overlapping relationship. As illustrated, this arrangement is particularly well suited for walls having both concave and convex curved or obtusely angled surfaces. As noted above, channel deformation notches 24 in flanges 20 permit channel member 10 to be bent on various transverse lines along its length, the bent lines always being disposed between clipping devices 12 and panels 114 mounted thereto.

Each of the depicted panels 114 includes an extending, undercut lateral edge 120 having a rearwardly disposed planar surface 120*a* which is adapted to overlie a beveled lateral extension 122 of the adjacent panel 114. The beveled configuration of lateral extension 122 permits panels 114 to be used with both convex and concave curvatures without permitting gaps between the panels. Such gaps would not only detract from the appearance of the paneling system but would also adversely effect the acoustic properties of the panel mounting system.

Operation of Embodiment of FIG. 6

The assembly of the system of FIG. 6 will now be described. Channel members 10 are first mounted to the wall 11, such as by screws (not shown), and any necessary transverse bends are effected along channel deformation notches 24. Clipping devices 12 are then pressed into the channel members as described above. As with the previously described embodiment, the panel at one extreme end of the wall to be covered should first be pressed into position (starting from the extreme left in FIG. 6); the next panel will then be positioned with its undercut lateral edge 120 disposed immediately over lever arms 46 and below undercut lateral edge 120 of the already-mounted panel 114. This next panel is then pressed into place, and the process is repeated until the entire wall 11 is covered.

In order to remove panels 114, the last panel which has been mounted to the wall is often the first to be removed. However any of the other panels may independently be removed by merely reaching in, between adjacent panels, with a flat tool, to release the engagement pressure exerted by gripping flange 40, thereby disengaging the panel. In any event, once a single panel 114 has been removed, the lever arms 46 of the adjacent panel are exposed for removal of the next panel, if desired.

Structure of Embodiment of FIGS. 7–9

Channel members 10 and clipping devices 12 of the embodiment of FIGS. 7–9 are identical to the components described above. This embodiment is depicted with a panel/strip configuration which corresponds to that discussed with respect to the embodiment of FIGS. 1–5 above, although this embodiment may alternatively utilize the panel design of the embodiment of FIG. 6.

The embodiment of FIGS. 7–9 is not well suited for use with panel walls having curved or cornered surfaces which must be paneled because, with this embodiment, channel members 10 are mounted to a conventional "T" or "I" type rail system. FIG. 9 depicts wall 11 having an I-shaped rail member 224 mounted thereto. Rail member 224 includes a channel mounting surface 224*a*. channel mounting clips 226 are utilized to mount channel members 10 to the channel mounting surfaces 224*a* of rail members 224. Each channel mounting clip 226 includes a pair of opposed rail engagement legs 228 which terminate in rail engagement lips 228*a* adapted to engage the lateral edges of the channel mounting surface 224*a* of rail member 224. Each channel mounting clip 226 also includes two pair of opposed, forwardly extending channel member engagement legs 230. These channel member engagement legs 230 terminate in engagement lips 230*a* which are adapted to fit through slots 30 in channel members 10 and thereby engage the channel members from the underside.

Operation of Embodiment of FIGS. 7–9

In order to mount the system of FIGS. 7–9, channel mounting clips 226 are clipped or slid onto the mounting surface 224*a* of each rail member 224 at intervals which correspond to the spacing between slots 30 in channel members 10. Channel members 10 are then fit onto channel mounting clips 226 by threading channel member engagement legs 230 and their engagement lips 230*a* through slots 30 in channel members 10. Channel member engagement legs 230 are then pressed inwardly so that engagement lips 230*a* engage channel member 10. Once the channel members 10 are positioned on rail members 124, the remainder of the system may be assembled as described above.

The structure of channel mounting clips 226 also permits joinder of adjacent ends of channel members 10 in the event a single channel member does not extend the entire height or length of the wall being covered. So used, one pair of channel member engagement legs 230 of channel mounting clip 226 is passed through slots 30 adjacent the end of one of the channel members 10 to be joined, while the second pair of engagement legs 230 are passed through slots 30 adjacent the end of the other channel member 10. This provides a more rigid assembly than would be possible without a single channel mounting clip for the two channel members being joined.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A system for alignably mounting a plurality of panels, each of which has a pair of substantially parallel, facing engagement surfaces on its back side, wherein the system comprises:

a plurality of substantially parallel channel members, each of which includes rearwardly extending flanges adjacent its lateral edges;

a plurality of clipping devices adapted to be mounted to each of said channel members, each of said clipping devices including opposing, rearwardly extending engagement means for engaging said channel member flanges, a pair of facing, forwardly and transversely extending gripping flanges for engaging the engagement surfaces of the panel, flexion means for flexing said gripping flanges toward each other to grip the engagement surfaces, and lever means for releasing the gripping force on the engagement surfaces, said lever means extending beyond a lateral edge of the panel being engaged by said device to permit operation thereof from a frontal position when a panel is engaged by said gripping flanges.

2. The system of claim 1 wherein said lever means of each said clipping devices comprise a pair of lever members, one of which is adapted to extend to each lateral side of the channel member to which said clipping device is mounted so that rearward pressing of said lever members disengages the panel.

3. The system of claim 2 wherein said channel member flanges define opposing clip engagement notches for receiving said clipping device engagement means.

4. The system of claim 3 wherein said channel member flanges further define opposing channel deformation notches adapted to reduce the resistance of said channel members to bending along transverse lines defined between opposing channel deformation notches, said channel deformation notches being disposed in alternating relationship with said clip engaging notches to permit bending of said channel members between the panels engaged by said clipping devices.

5. The system of claim 4 wherein each of said clipping devices includes a centrally disposed portion adapted to contact the channel member to which it is mounted when a panel is engaged by said gripping flanges, and wherein said lever members extend from said clipping device adjacent one of said gripping flanges so that rearward pressing of said lever members pivots the gripping flange to which it is mounted, thereby releasing the engaged panel.

6. The system of claim 1 further comprising means for mounting the back side of each of said channel members to a wall.

7. The system of claim 6 wherein said mounting means of each said channel member comprise:

a rail member mounted to the wall, said rail member extending parallel to each said channel member, said rail member including a mounting surface remote from the wall;

a plurality of channel mounting clips having rearwardly extending engagement members for engaging said mounting surface, and forwardly extending engagement members for gripping said channel member.

8. A clipping device for use in mounting a panel having a pair of substantially parallel, facing engagement surfaces on its back side, to a channel member having rearwardly extending flanges adjacent its lateral edges, wherein the clipping device comprises:

a pair of opposed, rearwardly extending engagement means for engaging the channel member flanges;

a pair of facing, forwardly extending gripping flanges adapted to engage the engagement surfaces;

flexion means for flexing said gripping flanges toward each other to grip the engagement surfaces; and lever means for releasing the engagement flexing of said flexion means, said lever means extending outwardly from each side of the device adjacent one of said gripping flanges, then in a direction which is substantially parallel to the channel member for a distance sufficient to permit frontal operation of said lever means when a panel is engaged by the device, so that a rearward pressing of said lever members displaces said one gripping flange away from the other gripping flange, thereby releasing the panel engagement surfaces.

9. The clipping device of claim 8 wherein each of said gripping flanges includes an outwardly extending portion and terminates in an inwardly extending lip, said lip having engagement teeth thereon for engaging the engagement surfaces.

10. A method of removably and alignably mounting a plurality of narrow panels to a stationary wall wherein each of the panels has a pair of opposed engagement surfaces, comprising the following steps:

mounting a plurality of parallel channel members to the wall, said channel members having opposed, rearwardly extending flanges, said flanges each defining spaced clip engagement notches which oppose like notches in the opposing flange;

alignably clipping a clipping device to each said channel member, said clipping devices each having a pair of rearwardly extending fingers for engaging said clip engagement notches, a pair of forwardly extending gripping flanges, and a pair of lever members, one of which extends outwardly from each lateral edge of said device and along a lateral edge of the channel member to which said device is mounted, said lever members being at least about half as long as the width of the panels being mounted;

aligning the engagement surfaces of a panel with said gripping flanges of said devices; and pressing the panel rearwardly so that said gripping flanges of each of said devices engage the engagement surfaces of the panel, while leaving a portion of each of said lever members exposed so that rearward pressing of said lever members of any one clipping device releases the panel from that one device.

11. The method of claim 10 wherein said channel member flanges define opposing channel deformation notches disposed in alternating relation with said clip engagement notches, and comprising the additional step of first bending said channel members at said channel deformation notches to conform said channel members to any variations in the wall.

12. The method of claim 10 wherein, simultaneous with the rearward pressing of the panel, the lever members of the clipping device to which the panel is being mounted are pressed rearwardly to open said clipping device to receive the panel.

13. A paneling system comprising:

a plurality of substantially parallel channel members;

a plurality of clipping devices adapted to be mounted to each said channel member, each said clipping device including opposing, rearwardly extending engagement means for engaging said channel members, a pair of facing, forwardly and transversely extending gripping flanges, flexion means for flexing said gripping flanges toward each, and lever means for releasing the flexing force of said gripping flanges; and a plurality of aligned panels, each of which includes a pair of substantially parallel, facing engagement surfaces on its back side adapted to receive said gripping flanges and be engaged thereby;

wherein said lever means of each said clipping device extends outwardly beyond a lateral edge of the panel engaged by that clipping device, to permit operation of said lever means from a frontal position to release the flexing force of said gripping flanges and thereby permit removal of said panel.

14. The paneling system of claim 12 wherein each said panel includes a first lateral edge having a beveled, generally forwardly facing surface, and a second lateral edge having an overlying extension with a planar, rearwardly facing surface adapted to overlie the beveled first lateral edge of the adjacent panel.

* * * * *